US010640245B2

(12) United States Patent
Gao

(10) Patent No.: US 10,640,245 B2
(45) Date of Patent: May 5, 2020

(54) SEPARATABLE LOWER MOLD OF STEEL STRAPPING MACHINE WITHOUT USING JOINT

(71) Applicant: DALIAN FIELD HEAVY-MACHINERY MANUFACTURING CO., LTD, Liaoning (CN)

(72) Inventor: Guowu Gao, Liaoning (CN)

(73) Assignee: DALIAN FIELD HEAVY-MACHINERY MANUFACTURING CO., LTD., Liaoning (CN)

( * ) Notice: Subject to any disclaimer, the term of this patent is extended or adjusted under 35 U.S.C. 154(b) by 200 days.

(21) Appl. No.: 15/547,766

(22) PCT Filed: Feb. 25, 2016

(86) PCT No.: PCT/CN2016/074536
§ 371 (c)(1),
(2) Date: Jul. 31, 2017

(87) PCT Pub. No.: WO2017/121014
PCT Pub. Date: Jul. 20, 2017

(65) Prior Publication Data

US 2018/0002046 A1 Jan. 4, 2018

(30) Foreign Application Priority Data

Jan. 12, 2016 (CN) ..... 2016 1 0020350

(51) Int. Cl.
*B65B 13/30* (2006.01)

(52) U.S. Cl.
CPC ..... *B65B 13/30* (2013.01)

(58) Field of Classification Search
CPC ..... B65B 13/30; B65B 13/305; B65B 13/22
(Continued)

(56) References Cited

U.S. PATENT DOCUMENTS 3,396,760 A * 8/1968 Kirsinas ..... B65B 13/345 140/93.4
3,794,086 A * 2/1974 Hall ..... B21F 9/02 140/93.2

(Continued)

FOREIGN PATENT DOCUMENTS

CN 2743231 Y 11/2005
CN 200942888 Y 9/2007

(Continued)

OTHER PUBLICATIONS

Chinese Patent Office, The State Intellectual Property Office of P.R. China, Search Report for Office Action in Counterpart Patent Application No. CN2016100203503, Search Report and Concise English Explanation, dated Sep. 1, 2017.

(Continued)

*Primary Examiner* — Jimmy T Nguyen
(74) *Attorney, Agent, or Firm* — Law Offices of Liaoteng Wang

(57) ABSTRACT

The steel strapping machine without using joint currently available from the market has three shortcomings. Firstly, packages cannot be strapped tightly. Secondly, a steel strap may get caught on a lower mold when the lower mold is taken out from underside of the steel strap. Thirdly, the strapping machine is not available for small packages. To overcome the shortcomings of the prior arts, the present disclosure proposes a separatable lower mold of the steel strapping machine without using a joint, which is formed as two parts being able to be closed together or separated from each other. The separatable lower mold has advantages that packages can be strapped tightly, the steel strap will not get caught on the lower mold when the lower mold is taken out from the underside of the steel strap and it is possible for the strapping machine to strap small packages.

8 Claims, 9 Drawing Sheets

(58) Field of Classification Search
USPC ..... 100/30, 33 R; 140/93.2, 93.4
See application file for complete search history.

(56) References Cited

U.S. PATENT DOCUMENTS

| | | | | |
|---|---|---|---|---|
| 3,978,899 | A | 9/1976 | Schroder | |
| 4,089,352 | A * | 5/1978 | Synek | B65B 13/30 140/93.2 |
| 4,154,158 | A | 5/1979 | Leslie et al. | |
| 5,501,252 | A * | 3/1996 | Bartzick | B65B 13/30 140/152 |

FOREIGN PATENT DOCUMENTS

| | | | |
|---|---|---|---|
| CN | 201102638 | Y | 8/2008 |
| CN | 101391661 | A | 3/2009 |
| CN | 201292021 | Y | 8/2009 |
| CN | 202715726 | U | 2/2013 |
| CN | 202987553 | U | 6/2013 |
| CN | 103523263 | A | 1/2014 |
| CN | 204895924 | U | 12/2015 |
| DE | 4336721 | A1 | 5/1995 |
| EP | 0827910 | A1 | 3/1998 |
| GB | 2040825 | A | 9/1980 |
| JP | S5577533 | U | 5/1980 |
| JP | S5577533 | A | 6/1980 |
| JP | S55107612 | U | 7/1980 |
| JP | S61502393 | A | 10/1986 |
| JP | 4255109 | B2 | 4/2009 |
| SU | 103864 | A | 11/1955 |
| SU | 397428 | A2 | 9/1973 |
| SU | 1024375 | A1 | 6/1983 |
| SU | 1121186 | A1 | 10/1984 |

OTHER PUBLICATIONS

International Searching Authority, The State Intellectual Property Office of P.R. China, Form PCT/ISA/210 for IA Application No. PCT/CN2016/074536, International Search Report, dated Oct. 19, 2016.

Japanese Patent Office, Office Action and Search Report for Japanese Counterpart Application No. 2017-542439, with concise English Explanation, dated Jun. 26, 2017.

European Patent Office, Extended Search Report for European Counterpart Application No. 16816569.4, dated May 17, 2018.

Federal Service for Intellectual Property (ROSPAT), Russian Patent Office—Office Action in Russian Counterpart Application No. 2017127773, with concise English Explanation, dated Jul. 20, 2018.

The first office action dated Oct. 16, 2019 for Indian Application No. 201717027163, 6 pages.

* cited by examiner

SEPARATABLE LOWER MOLD OF STEEL STRAPPING MACHINE WITHOUT USING JOINT

CROSS-REFERENCE TO RELATED APPLICATIONS

This application claims the benefit of PCT Patent Application Serial No. PCT/CN2016/074536 entitled "SPLIT LOWER CUTTERS FOR BUCKLE-FREE STEEL BELT STRAPPING TOOL" filed Feb. 25, 2016, which in turn claims priority from Chinese National Patent Application No. 201610020350.3, filed Jan. 12, 2016, the disclosures of which are each incorporated by reference herein in their entireties.

TECHNICAL FIELD

The present disclosure relates to a technical field of strapping machine, and specifically relates to a separatable lower mold of a steel strapping machine without using joint.

BACKGROUND

The steel strapping machine without using joint has advantages of easy operation, nice appearance and low cost. However, there are three shortcomings described as below limiting the promotion and application thereof. Firstly, the lower mold of the steel strapping machine without using joint is formed as an inseparatable whole which contains a hook, and the hook is used to lift the steel strap before the lower mold is taken out upon a joint is made, so that the lower mold can be taken out. Since the lower mold has a large size along the length of steel strap and has a large thickness, and meanwhile the hook stretches upwards the steel strap, a large gap is generated between the steel strap and a top surface of the strapped package after the lower mold is taken out from underside of the steel strap, resulting in that the strap for the package is not tight enough. As the package to be strapped is smaller, the above-mentioned problem is severer. Secondly, after a joint is made for the steel strap, a situation usually occurs in which the steel strap gets caught on the lower mold when the lower mold is taken out. Thirdly, the lower mold of the steel strapping machine cannot strap small packages due to its design, since as the strapped package is smaller, it is more difficult for the lower mold to be taken out from the underside of the strapped package, and sometimes the lower mold cannot be taken out. Therefore, it is necessary to design a lower mold of the strapping machine, which can strap the packages tightly and can strap small packages, while not catching the steel strap when being taken out.

SUMMARY

To overcome the shortcomings of the prior arts, the present disclosure provides a separatable lower mold of steel strapping machine without using joint. The specific technical features are set forth as follows: the lower mold of the steel strapping machine without using joint is formed as two parts, which are capable of being separated from each other or closed together, wherein the two parts are closed together before a joint is made, and are separated from each other after the joint is made, to be removed from the steel strap. Each of the two parts has a cutter edge or a blade mounted with the cutter edge, and in the case that the two parts are closed together, the cutter edge surfaces of the two parts or two blades keep a certain distance from each other, and both the cutter edge surfaces are disposed towards a center of the steel strap. After the joint is made, the notch is located between the two cutter edge surfaces. Therefore, when the two parts of the lower mold are taken out from the underside of the steel strap, the notch of the steel strap has no obstruction to the lower mold, and thus there is no need to lift the steel strap via a hook. The separatable lower mold has the advantages described as below. Firstly, the lower mold does not contain a hook, and thus the lower mold has a smaller size along the length of the steel strap and is thinner; therefore, the strapping is tighter. Secondly, since both the cutter edge surfaces of the two parts of the lower mold or the blades are located outside of the notch, the steel strap will not get caught on the lower mold when the two parts of the lower mold are separated towards two sides of the steel strap and taken out from the underside of the steel strap. Thirdly, since the strapping machine with the lower mold having two parts cancels a step of lifting the steel strap by the hook, it becomes possible for the strapping machine to bundle small packages.

The specific technical solution of the present disclosure provides a separatable lower mold of steel strapping machine without using joint. The description relates to the following parts: an upper mold 1, a left part of a lower mold 2, a right part of lower mold 3, feed roller 4, and a base 7. Wherein, the upper mold 1, the left part of lower mold 2, the right part of lower mold 3 and the feed roller 4 are all mounted on the base 7, which can move up and down. Each of the upper mold 1, the left part of lower mold 2 and the right part of lower mold 3 has a cutter edge or a blade mounted with a cutter edge. The upper mold 1 can move up and down, and the left part of lower mold 2 and the right part of lower mold 3 can be separated from each other or closed together. In the case that the strapping machine wants to strap the package 5, the left part of lower mold 2 and the right part of lower mold 3 are closed together, and the feed roller 4 is rotated in a forward direction so as to push the steel strap 6 to pass through an area between the upper mold and the lower mold. Upon an end of the steel strap 6 winds around the package 5 for one cycle and arrives the area between the upper mold and the lower mold again, two ends of the steel strap 6 are overlapped with each other and the feed roller 4 stops feeding the steel strap. The base 7 is moved downwards until bottom surfaces of the left part of lower mold 2 and the right part of lower mold 3 come into contact with a top surface of the package 5. Then, the feed roller 4 is rotated in a reverse direction to pull the steel strap 6 outwards. When the steel strap 6 tightly warps the package 5, the upper lower 1 is moved downwards to shear the steel strap 6 together with the left part of lower mold 2 and the right part of lower mold 3, so as to generate a notch and make a joint. After the joint is made, the upper mold 1 is moved upwards, and the left part of lower mold 2 and the right part of lower mold 3 are separated towards left and right sides respectively, to be taken out from underside of the steel strap 6. After the lower mold is taken out, the base 7 is moved upwards to the initial position, and the left part of lower mold 2 and the right part of lower mold 3 are moved towards a central position to be closed together, and prepared for next strapping. Thus, one cycle of strapping procedure is completed.

DETAILED DESCRIPTION

Figure 1:
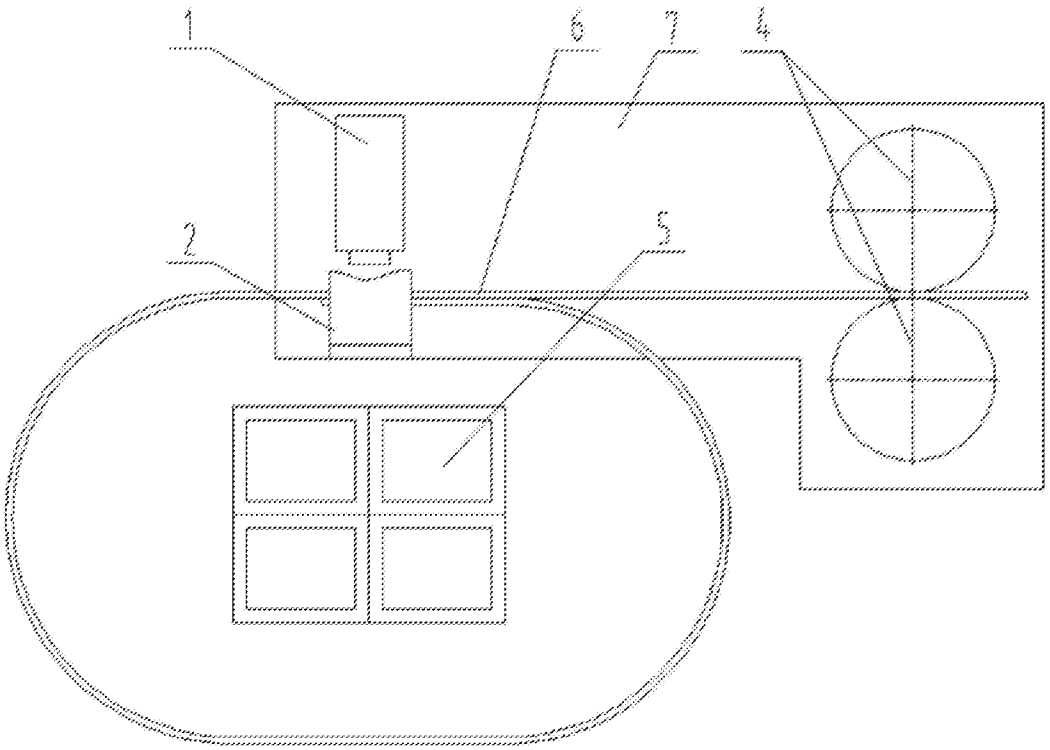
FIG. 1 is a global schematic diagram showing a specific structure of the present disclosure.
Figure 2:
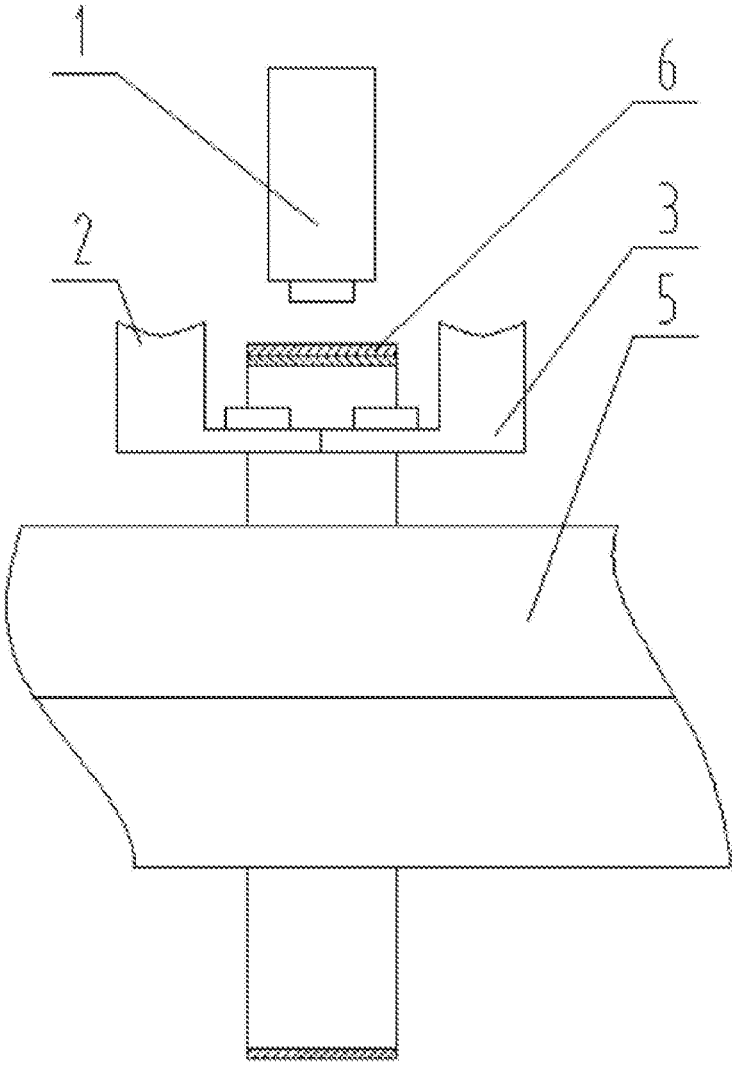
FIG. 2 is a schematic diagram showing a partial sectional view of the specific structure of the present disclosure.

The present disclosure will be described in detail below by reference to specific structure. FIG. 1 and FIG. 2 show a lower mold of a steel strapping machine without using joint. The description relates to the following parts: an upper mold 1, a left part of lower mold 2, a right part of lower mold 3, feed roller 4, a base 7, a steel strap 6 and a package 5. Wherein, the upper mold 1, the left part of lower mold 2, the right part of lower mold 3 and the feed roller 4 are all mounted on the base 7, which can move up and down. Each of the upper mold 1, the left part of lower mold 2 and the right part of lower mold 3 has a cutter edge or a blade mounted with a cutter edge. The left part of lower mold 2 and the right part of lower mold 3 can be separated from each other or closed together. In the case that the left part of lower mold 2 and the right part of lower mold 3 are closed together, the upper mold 1 can be moved downwards and shear the steel strap together with the left part of lower mold 2 and the right part of lower mold 3, to generate a notch so as to make a joint.

Figure 3:
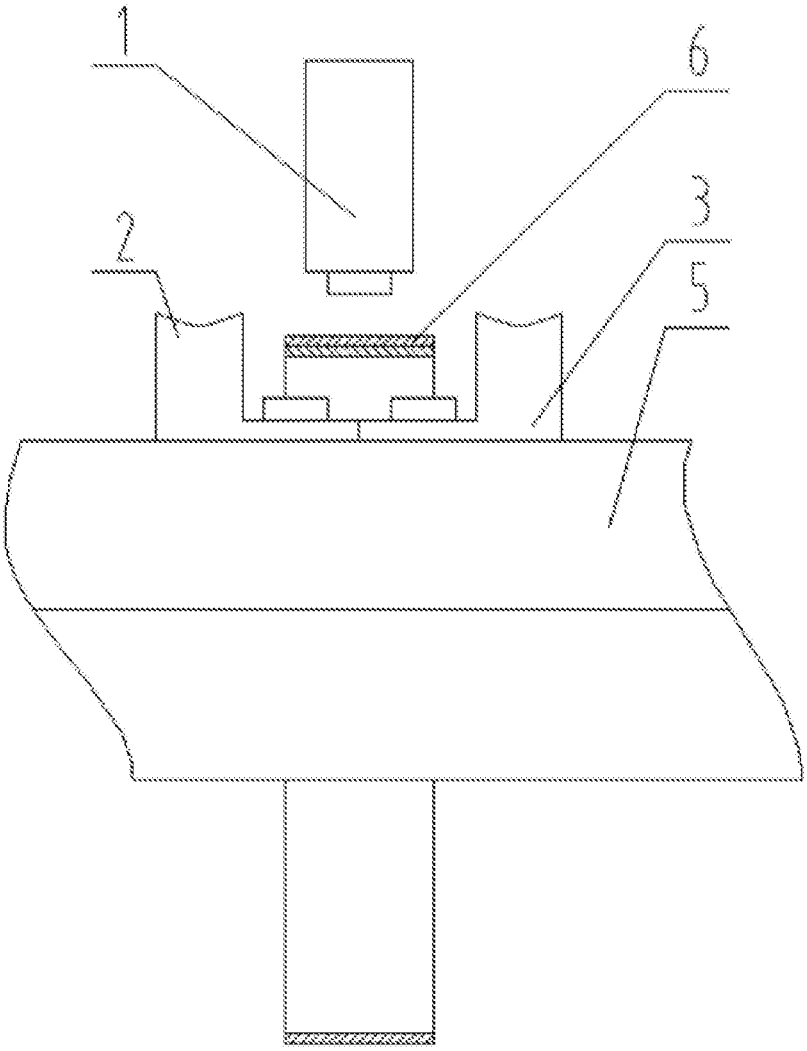
FIG. 3 is a schematic diagram showing that the base 7 moves downwards in the present disclosure.
Figure 4:
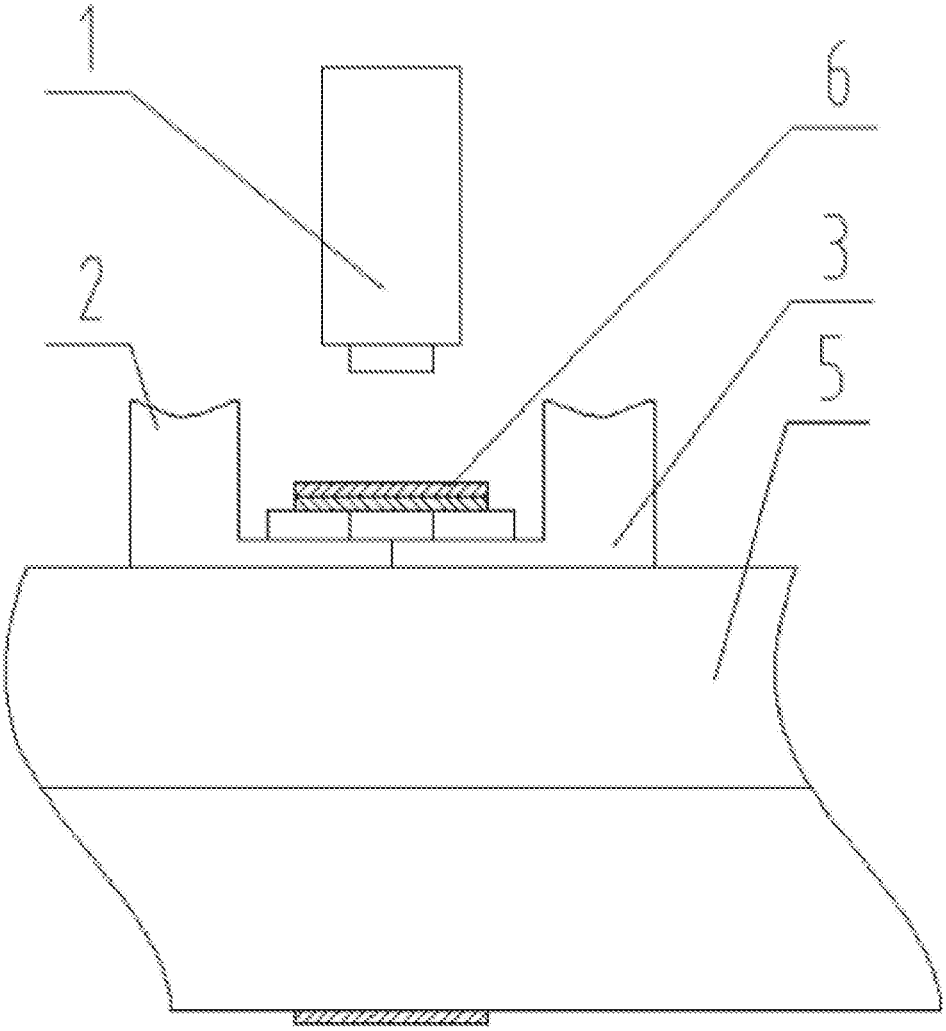
FIG. 4 is a schematic diagram showing that the feed roller 4 is rotated in a reverse direction to pull the steel strap 6 outwards in the present disclosure.
Figure 5:
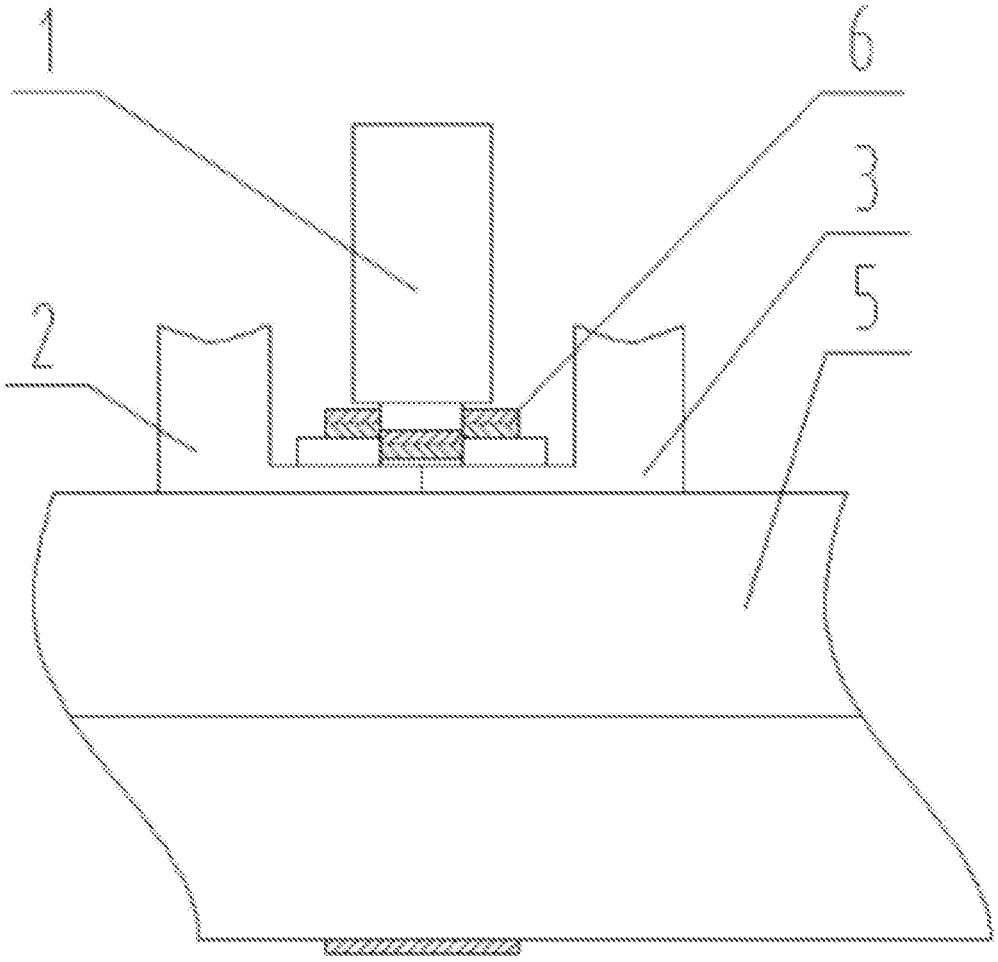
FIG. 5 is a schematic diagram showing that the upper mold 1 is moved downwards to shear the steel strap 6 to generate a notch and make a joint in the present disclosure.
Figure 6:
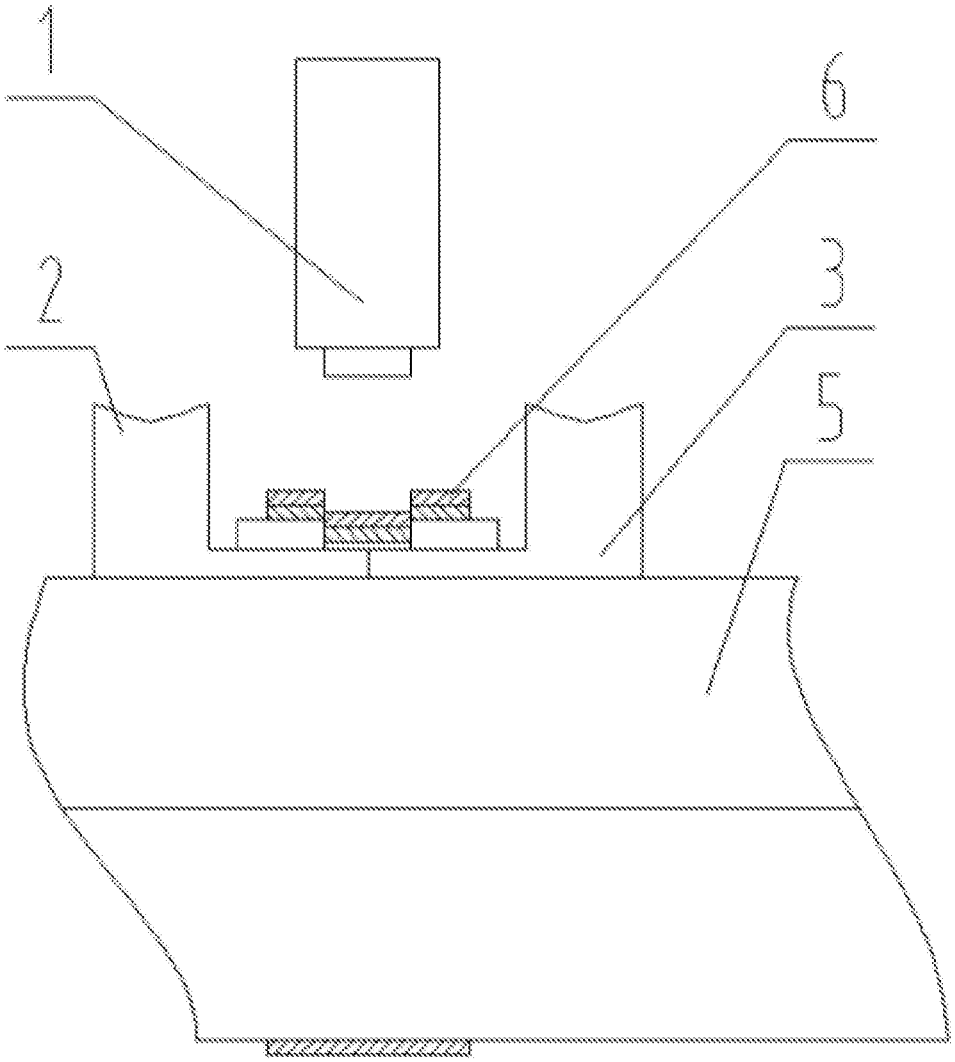
FIG. 6 is a schematic diagram showing that the upper mold 1 is raised after the joint is made in the present disclosure.
Figure 7:
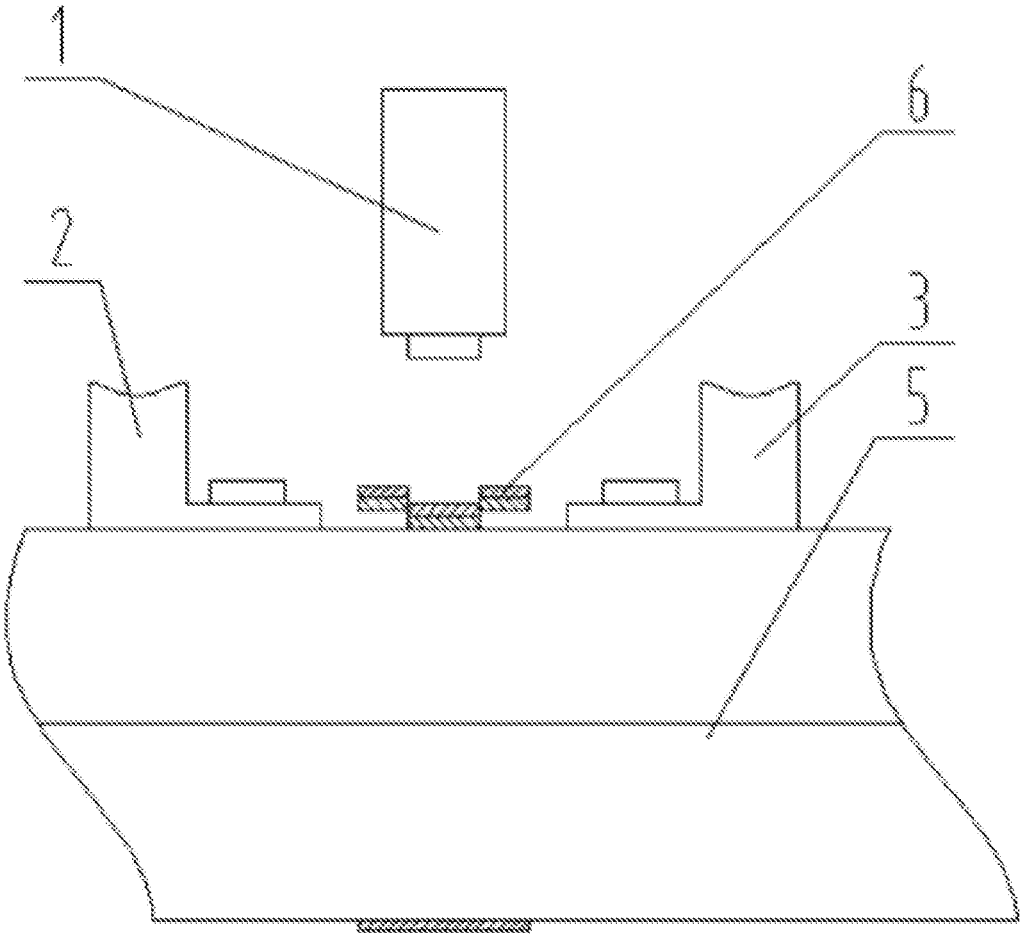
FIG. 7 is a schematic diagram showing that the left part of lower mold 2 and the right part of lower mold 3 are separated towards the left and right sides respectively, being taken out from underside of the steel strap 6 in the present disclosure.
Figure 8:
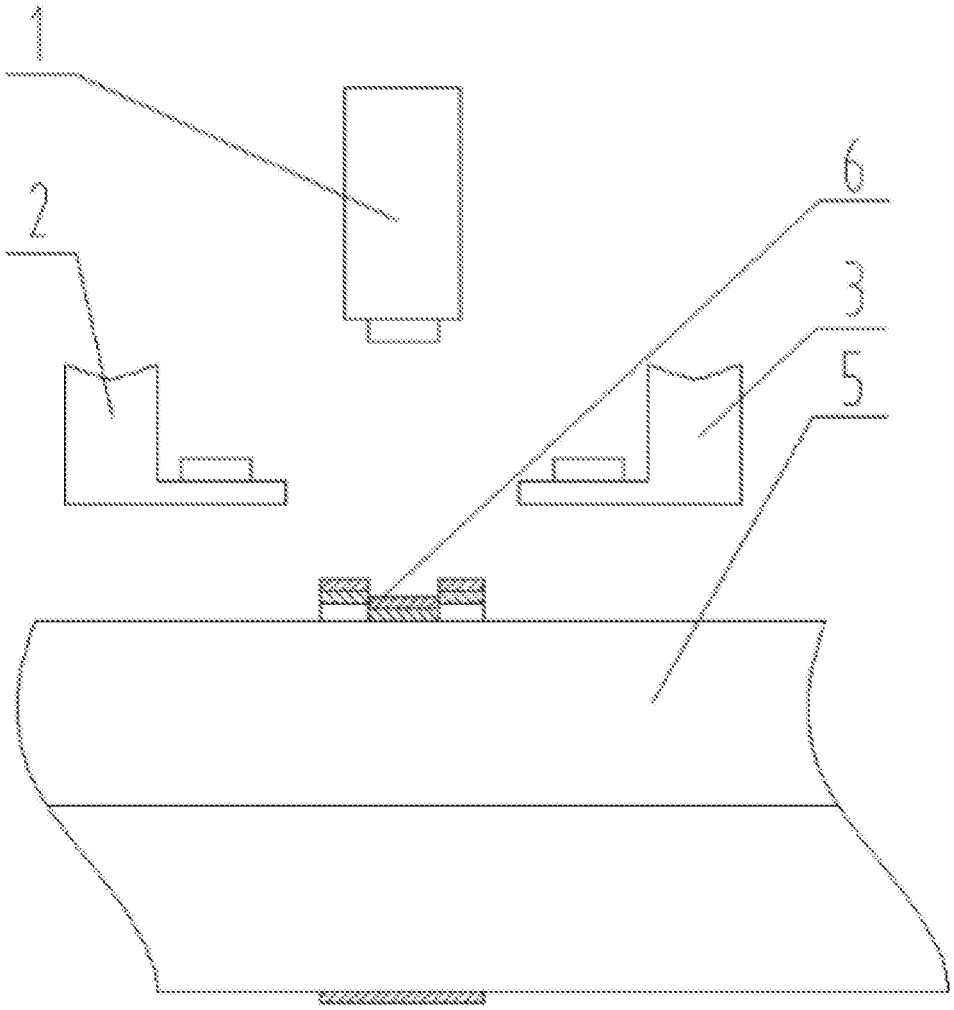
FIG. 8 shows a schematic diagram showing that the base 7 is moved upwards to the initial position in the present disclosure.
Figure 9:
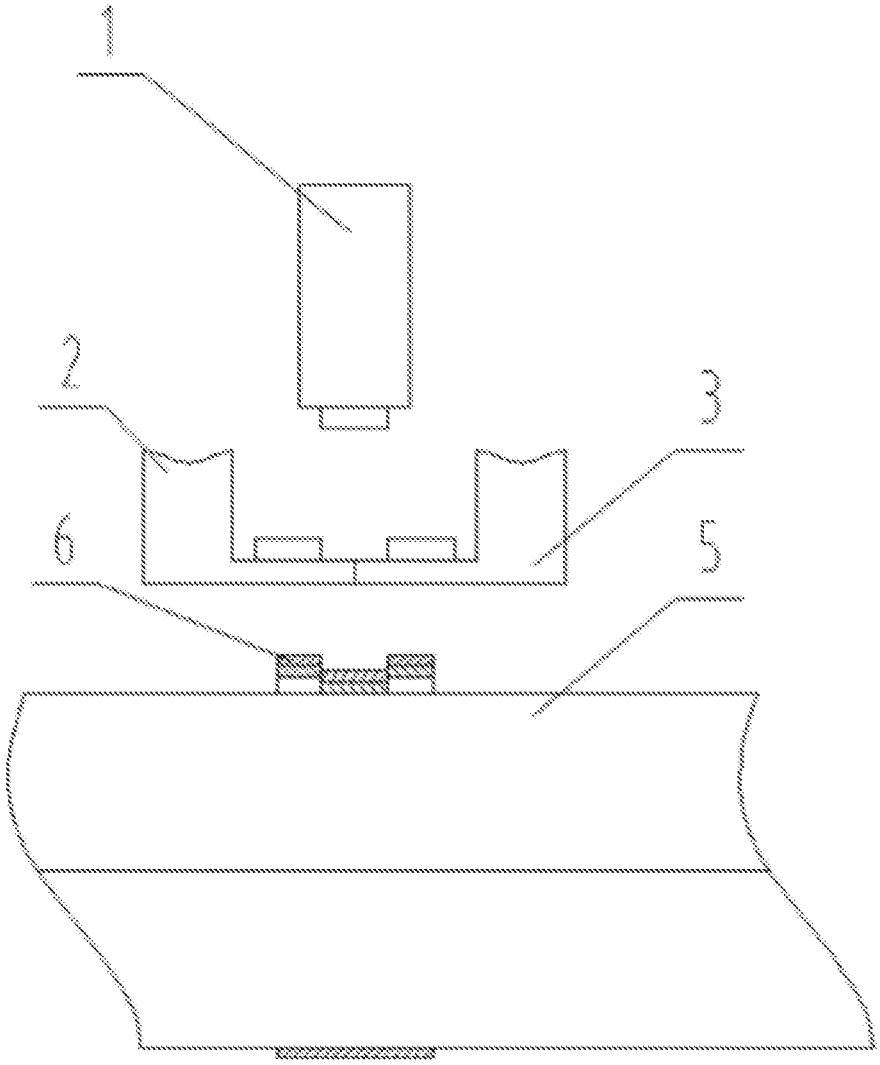
FIG. 9 shows a schematic diagram showing that the left part of lower mold 2 and the right part of lower mold 3 are closed towards a central position and prepared for the next strapping in the present disclosure.

As shown in FIG. 2, in the case that the strapping machine wants to strap the package 5, the left part of lower mold 2 and the right part of lower mold 3 are closed together, and the feed roller 4 is rotated in a forward direction so as to push the steel strap 6 to pass through an area between the upper mold and the lower mold. Upon an end of the steel strap 6 winds around the package 5 for one cycle and arrives the area between the upper mold and the lower mold again, two ends of the steel strap 6 are overlapped with each other and the feed roller 4 stops feeding the steel strap. As shown in FIG. 3, the base 7 moves the upper mold 1, the left part 2, the right part 3 and the feed roller 4 downwards from an initial position to a position where bottom surfaces of the left part of lower mold 2 and the right part of lower mold 3 come into contact with a top surface of the package 5. As shown in FIG. 4, the feed roller 4 is rotated in a reverse direction to pull the steel strap 6 outwards, so that the steel strap 6 tightly warps the package 5. As shown in FIG. 5, the upper lower 1 is moved downwards to shear the steel strap 6 together with the left part of lower mold 2 and the right part of lower mold 3, so as to generate a notch and make a joint. As shown in FIG. 6, after the joint is made, the upper mold 1 is moved upwards. As shown in FIG. 7, the left part of lower mold 2 and the right part of lower mold 3 are separated towards two sides of the steel strap 6 respectively, being taken out from underside of the steel strap 6. As shown in FIG. 8, the base 7 is moved upwards to the initial position. As shown in FIG. 9, the left part of lower mold 2 and the right part of lower mold 3 are closed together, and prepared for next strapping. Thus, one cycle of strapping procedure is completed.

What is claimed is:

1. A steel strapping machine without using joint, comprising:

a mold, including an upper mold and a lower mold, which cooperate with each other to shear a steel strap so as to generate a notch, wherein:

the lower mold is formed as a separatable lower mold which is configured to open and close;

the separatable lower mold is closed before a joint is made, and is opened after the joint is made so that the lower mold is removed away from the steel strap, wherein the steel strapping machine further comprises a base and a feed roller, the feed roller and the mold are mounted on the base, and the base is configured to move up and down and carry the feed roller and the mold to synchronously move up and down, the lower mold comprises a left part of the lower mold and a right part of the lower mold, which are configured to separate from each other and the left part contacts the right part when the lower mold is closed, and after the joint is made, the upper mold is moved upwards, the left part of the lower mold and the right part of the lower mold are separated towards two sides of the steel strap in a linear manner and are horizontally taken out from underside of the steel strap.

2. The steel strapping machine without using joint according to claim 1, wherein, each of the left part of the lower mold and the right part of the lower mold is provided with a cutter edge.

3. The steel strapping machine without using joint according to claim 2, wherein, in the state that the left part of the lower mold and the right part of the lower mold are closed together, the cutter edge of the left part of the lower mold and that of the right part of the lower mold keep a certain distance from each other, and cutter edge surfaces of both the cutter edges are disposed towards a center of the steel strap.

4. The steel strapping machine without using joint according to claim 3, wherein, the notch of the steel strap is located between the cutter edge of the left part of the lower mold and that of the right part of the lower mold, after the notch is generated.

5. The steel strapping machine without using joint according to claim 1, wherein, each of the left part of the lower mold and the right part of the lower mold is provided with a blade.

6. The steel strapping machine without using joint according to claim 5, wherein, in the state that the left part of the lower mold and the right part of the lower mold are closed together, cutter edge surface of the blade on the left part of the lower mold and that of the blade on the right part of the lower mold keep a certain distance from each other.

7. The steel strapping machine without using joint according to claim 6, wherein, the cutter edge surface of the blade on the left part of the lower mold and that of the blade on the right part of the lower mold are disposed towards a center of the steel strap.

8. The steel strapping machine without using joint according to claim 6, wherein, the notch of the steel strap is located between the blade on the left part of the lower mold and that on the right part of the lower mold, after the notch is generated.

* * * * *